United States Patent [19]

Baxter et al.

[11] Patent Number: 4,824,000

[45] Date of Patent: Apr. 25, 1989

[54] PILL-DIVIDING APPARATUS

[75] Inventors: Genevieve S. Baxter, 225 Lake St., Lake Dallas, Tex. 75065; Roy L. Chandler, Burleson, Tex.

[73] Assignee: Genevieve S. Baxter, Dallas, Tex.

[21] Appl. No.: 159,527

[22] Filed: Feb. 9, 1988

[51] Int. Cl.[4] ..... B26F 3/00

[52] U.S. Cl. ..... 225/103; 30/124; 225/93

[58] Field of Search ..... 225/103, 104; 30/124, 30/120.1, 120.3

[56] References Cited

U.S. PATENT DOCUMENTS

| | | | |
|---|---|---|---|
| 3,517,871 | 6/1970 | Gaffney et al. | 225/103 |
| 4,179,806 | 12/1979 | Lieptz | 30/124 |
| 4,473,192 | 9/1984 | Urban et al. | 225/103 |

*Primary Examiner*—Frank T. Yost
*Assistant Examiner*—Willmon Fridie, Jr.
*Attorney, Agent, or Firm*—Charles D. Gunter, Jr.

[57] ABSTRACT

An apparatus for dividing a pill into two portions (i.e., halves, quarters, etc.), such that one portion is immediately accessible and the second portion is captured for later use. The apparatus includes an anvil-like platform adapted to support a pill in a generally horizontal mode. A centering means is sized and oriented for positioning the pill on top of the platform in such a way that the pill is bisected by a cleavage plane, regardless of the size of the pill. The centering means preferably includes a pair of converging walls, with each wall lying in a plane that is substantially perpendicular to the plane established by the platform. A gap between the convergent ends of the two walls lies in the cleavage plane, and the gap has a width which is just sufficient to receive a movable blade. The blade may be moved between two major positions, with one being a raised (or retracted) position and the other being a completely lowered position. The blade is mounted so that it will move in the cleavage plane, and any pill which is centered on top of the platform between the converging walls will inherently be divided in half when the blade is completely lowered. The blade is mounted on a spring-loaded handle in order that the blade will be retracted from its lowered position when pressure on the handle is released. A compartment-like structure is provided for conveniently capturing and storing half of any pill that has been split so as to prevent it from mixing with any portion of the remainder of the pill. Affixed to that side of the platform which is away from the compartment is a chute-like or scoop-like structure for dispensing the uncaptured or "free" portion of the pill. The chute-like structure includes a tray having two guide walls, and the tray extends outwardly away from the side of the platform. The end of the tray which is farthest from the platform is open, so that the uncaptured pill portion may be easily dispensed into a person's hand, a glass, a storage bottle, etc. The apparatus includes a second handle for mounting the platform. Each of the first and second handles preferably has a length of about five inches to provide adequate leverage for comfort in cutting any number of pills.

15 Claims, 1 Drawing Sheet

PILL-DIVIDING APPARATUS

BACKGROUND OF THE INVENTION

This invention relates generally to a pill-dividing apparatus; more specifically it relates to an apparatus for accurately dividing a pill into two halves, with one half being immediately accessible and the second half being captured for later use.

It is common in the medical field to split a tablet or pill so that fractional dosages of medication, vitamins, etc., may be conveniently taken by or administered to a person. Doctors frequently prescribe medication for an adult or child patient in fractional dosages, such as one-quarter pill, one-half pill, etc. But because medication in pill form is normally available in what will be called "unit" dosages, a nurse or a patient is required to divide the pill into equal portions in order to dispense a fractional dose—while retaining the remaining portion for subsequent use. Finding a convenient place to store the unused portion of a pill is often a nuisance, and handling the small, divided halves, quarters, etc., can be awkward for persons with non-dextrous hands. Another problem in preparing a fractional dosage is preserving the pill's cohesion while it is being divided, so that at least the portion that is to be retained will maintain its original state. If a pill disintegrates into small granules while being divided, it would be difficult for a person to segregate the crumbled pill into equal portions. Hence, there has existed a need for a pill-dividing device which may be easily used to prepare and dispense a fractional dosage of pill-type medication--and which securely captures and stores the remaining portion of the medication for later use.

Of course, there have been several prior art devices which have been proposed for breaking or dividing a pill, so that a fractional dosage may be provided for a patient. Examples of such devices are shown in the following U.S. Pat. Nos. 4,173,826 to Leopoldi et al. entitled "Apparatus for Cutting Pills"; and 4,199,863 to Deckert entitled "Pill Cutter". These devices may be able to divide a pill into two pieces, but they are not adapted to capture and store the remaining unused piece of the pill. Furthermore, if the pill disintegrates into minute granules after it is split, there is no convenient way of isolating one-half of the pill from the other half so as to keep the granules from mixing.

There is a device shown in U.S. Pat. No. 4,473,192 to Urban et al. entitled "Tablet Breaking Device" which addresses the need to store broken pill portions. However, after a pill is broken using this device, the jagged top of the broken pill portion—which is firmly wedged in the tapered groove—will actually project upwardly so as to prevent the lid from being fully closed over the open container. Thus, the "unheld" portion of the pill is not really captured, and it could fall out of the container if the Urban device was turned sideways or upside down. Also, because of the geometry of the tapered groove, an unusually thick pill having a small diameter could not conveniently be broken into equal halves, quarters, etc.

Another prior art device teaches the use of a box-like structure having a lid for capturing and storing one-half of a pill. This device is shown in U.S. Pat. No. 4,179,806 to Lieptz entitled "Pill-Splitting Implement with Non-Crumbling Characteristic." Inside the box-like structure are a pair of flexible holding arms that are supposed to apply inwardly directed forces to the pill and hold it together after it has been divided. However, such holding arms would not be effective to preserve the cohesion of a brittle pill and prevent it from disintegrating into minute fragments or granules when the pill is split. So, the pill granules could pass around the holding arms and easily mix at the bottom of the pill box, making it difficult for a person to accurately segregate one-half of a broken pill. Also the Lieptz construction requires that a person manipulate the pill—with a thumb and finger—so as to position the pill between the holding arms. If the pill does not disintegrate after being split, the small pill pieces must be handled again, so that one portion may be dispensed and the other portion may be placed in some storage container. And, if a quarter-pill dosage is required, a non-dextrous person would have a hard time grasping and removing one-half of a pill from a small storage container and orienting it between the holding arms. Unfortunately, to use this device a person must repeatedly handle the small, divided pill pieces, thereby increasing the chances of dropping them or possibly contaminating them if the person's hands are unclean. And in an environment where cleanliness is critical (i.e., a hospital, emergency clinic, etc.), minimizing the handling of pills is very important--especially if the handler might unknowingly be infected with a contagious disease. That is, a doctor, nurse, pharmacist or other health industry worker who might be infected with a contagious disease would certainly not want to repeatedly touch medication that was going to be administered to patients under his or her care.

One other prior art device shown in U.S. Pat. No. 4,330,936 to Swarth entitled "Compressed Tablet-Splitting Holder" purports to have structure adapted to preserve the cohesion of a pill's granulation after it is split, but this device lacks any cutting means for easily dividing the pill. To use the Swarth device, a thumb and forefinger of one hand are brought together so as to exert a steady clamping force on the holder jaws to firmly envelop a portion of the pill. Then, the exposed portion of the pill, which will presumably be about one-half, may be broken way by applying a transverse force with the thumb and forefinger of the other hand. Unfortunately, persons with decreased hand strength or those suffering from diseases such as arthritis, or certain amputees, would encounter considerable difficulty using the Swarth device. Also, even when a Swarth device is successfully used to break a pill in half, there is no compartment-like structure adapted for capturing any unused portion of the pill—or for reliably capturing very small pieces if the pill crumbles.

While most of the above-described devices have been constructed for breaking or splitting pill-type medication, it seems that the designers of these prior art devices have not given sufficient attention to the need for a device which is easy to use and which is adapted to conveniently store what may be aptly called the broken but unused portion of a pill. Therefore, there has remained a need for a pill-dividing apparatus which may be readily used by persons having impaired strength in their hands as well as persons who may have a need to break dozens of pills at one time (e.g., nurses in a multi-patient facility). It is an object of this invention to provide such a pill-dividing apparatus.

Another object is to provide a pill-dividing apparatus which is adapted to conveniently isolate and store the unused pill portions for later consumption.

A further object is to provide a pill-dividing apparatus which has a means for readily centering a pill so that a person does not have to both grasp and position the pill in order to reliably divide it into equal parts.

One more object is to provide a pill-dividing apparatus having a means for conveniently dispensing one-half of a pill so as to minimize handling of the medication.

Still another object is to provide a pill-dividing apparatus which has a blade for dividing a pill, with the apparatus adapted so that the blade may be manually replaced with a new one at any time.

These and other objects will no doubt be apparent from a reading of the specification and claims, and from a study of the accompanying drawing illustrating certain facets of the invention.

BRIEF DESCRIPTION OF THE INVENTION

Figure 1:
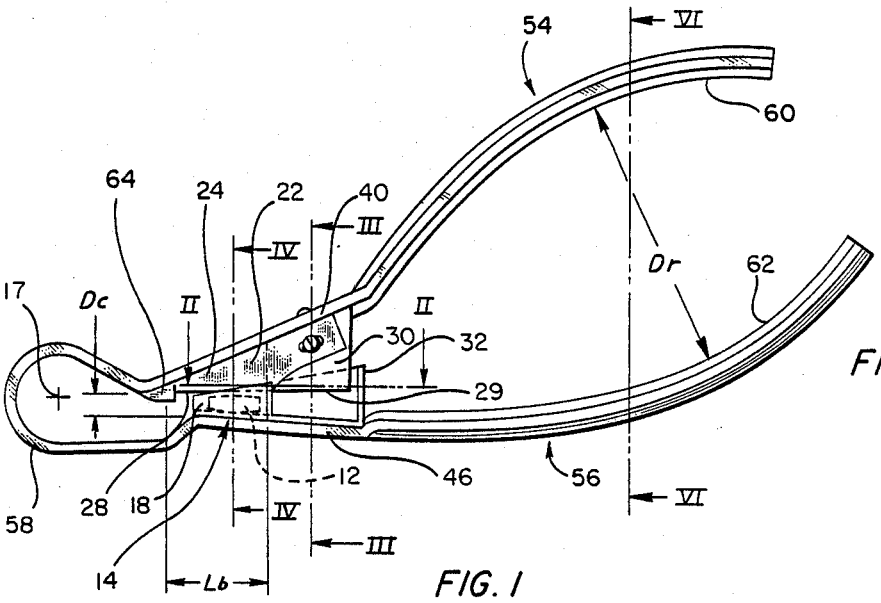
FIG. 1 is an elevational side view of one embodiment of the invention showing a pill-dividing apparatus having an anvil-like platform, with the platform being oriented such that it lies in a plane that is substantially horizontal, and also showing a movable blade poised above a disk-shaped pill which is resting on the platform.

In brief, the invention includes an apparatus for dividing a pill into two portions (i.e., halves, quarters, etc.), such that one portion is immediately accessible and the second portion is captured for separate or later use. The apparatus includes an anvil-like platform adapted to support a pill in a generally horizontal mode. A centering means is sized and oriented for positioning the pill on top of the platform in such a way that the pill is bisected by a cleavage plane, regardless of the size of the pill. The centering means preferably includes a pair of converging walls, with each wall lying in a plane that is substantially perpendicular to the plane established by the platform. The small gap between the convergent ends of the two walls lies in the cleavage plane, and the gap has a width which is just sufficient to receive a movable blade.

The blade may be moved between two major positions, with one being a raised (or retracted) position and the other being a completely lowered position. The blade is mounted so that it will move in the cleavage plane, and any pill which is centered on top of the platform between the converging walls will inherently be divided in half--when the blade is lowered from its retracted position to a pill-fracturing position and then to its completely lowered position. The blade is mounted on a spring-loaded handle in order that the blade will be retracted from its lowered position when pressure on the handle is released. A compartment-like structure is provided for conveniently capturing and storing half of any pill that has been split so as to prevent it from mixing with any portion of the remainder of the pill. The compartment-like structure is effectively sealed off when the blade is moved to its completely lowered position; and the compartment is opened when the blade is retracted.

Affixed to that side of the platform which is away from the compartment is a chute-like structure for dispensing the uncaptured or "free" portion of the pill. The chute-like structure includes a tray having two guide walls, and the tray extends outwardly away from the side of the platform. The end of the tray which is farthest from the platform is open. so that the uncaptured pill portion may be easily dispensed into a person's hand, a glass, a storage bottle, etc. Without touching either half of a divided pill, one half may be securely stored in the compartment, while the other half may be conveniently dispensed through the chute. The design minimizes handling (i.e., grasping and touching) of small, divided pill portions that are going to be consumed.

The apparatus includes a second handle for mounting the platform. Each of the first and second handles preferably has a length of about five inches to provide adequate leverage for comfort in cutting any number of pills. Also, the elongated handles make it easier for persons with weakened or impaired hands (such as elderly persons or those afflicted with arthritis) to use the pill-dividing apparatus.

DETAILED DESCRIPTION OF A PREFERRED EMBODIMENT OF THE INVENTION

Figure 2:
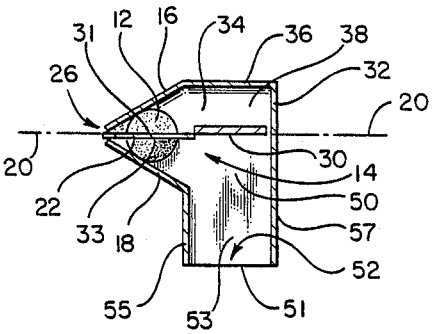
FIG. 2 is a cross-sectional top view of the blade and platform, taken in a horizontal plane through the blade and represented by the lines 2—2 in FIG. 1, and showing the pill centered and positioned immediately next to a pair of converging walls so as to be bisected by a cleavage plane.

Referring initially to FIGS. 1 and 2, a pill-dividing apparatus 10 is shown with a disk-shaped pill 12 oriented and positioned so that it may be divided into two equal halves. The pill-dividing apparatus 10 includes an anvil-like platform 14 adapted to support the pill 12 in a generally horizontal mode. The terms horizontal and vertical, upper and lower, etc., shall be used herein as if the apparatus is being held in the palm of a person's hand in such a way that the pill-supporting surface of the platform 14 lies in a substantially horizontal plane. Thus, what would appear to be up or down, horizontal or vertical, etc., with respect to the platform 14 when it is generally level shall be used herein as reference directions.

Affixed to the platform 14 is a means for readily centering the disk-shaped pill 12 on top of the platform, so that a person does not have to grasp and orient the pill to evenly divide it. The centering means is adapted to accommodate various sizes and shapes of pills (i.e., ellipsoid-shaped, cylinder-shaped, etc.). The centering means preferably includes first and second converging walls 16, 18 lying in planes which extend upwardly away from the plane established by the platform 14. The pill 12 may be positioned immediately next to both walls 16, 18 so as to be bisected by a cleavage plane 20. The cleavage plane 20 extends between the two converging walls 16, 18 and is substantially perpendicular to the platform's pill-supporting surface. In this way, both walls 16, 18 are disposed to cooperate with each other so as to orient a pill in such a way that it will be divided (into halves, quarters, etc.) by a movable blade 22. A small gap 26 lies between the convergent ends of walls 16, 18, and it has a width that is just sufficient to receive the movable blade 22.

Figure 3:
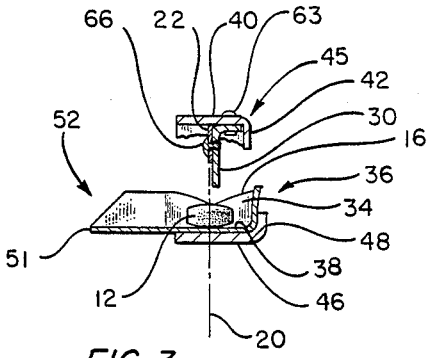
FIG. 3 is a cross-sectional view of the apparatus, taken in a vertical plane represented by the lines 3—3 in FIG. 1 (with some structure that is not in the vertical plane being omitted for clarity), and showing a L-shaped blade support member with an open compartment-like structure on the right side of the support member and a chute-like structure on the left side of the support member.

Referring additionally to FIG. 3, the cleavage plane 20 is established by the cutting path of the movable blade 22 which is positioned above the anvil-like platform 14. The blade 22 is mounted to a mechanical means, so that the blade may be alternately moved to a pill-fracturing position—or retracted at will. The mechanical means includes upper and lower handles 54, 56; the movable blade 22 is mounted to a structural support (and separating) member 30 which is in turn mounted to the end region 40 of upper handle 54. The anvil-like platform 14 is mounted to the base region 46 of lower handle 56. The handles 54, 56 are connected near one end of the apparatus 10 by a U-shaped section, and the handles are moved with respect to each other about an imaginary pivot point which is designated in FIG. 1 by the numeral 17. The handles 54, 56 and connecting means 58 are ideally formed from one somewhat flexible steel band which is preferably about fourteen inches long and about ¾ inch wide. And, when a suitable material is employed e.g., Type 302 stainless steel in the full hard condition, the connecting member 58 will not only serve to hold and orient the handles 54, 56, it will also function as a biasing means—to separate the handles after they have been released from a squeezed or pill-fracturing position. The reason for having a relatively wide steel band as the raw stock from which an apparatus 10 is fabricated should now be apparent. That is, if the connecting member 58 was made too narrow, there might be a possibility of some undesirable twisting or sideward movement as the handles are brought together; but making the connecting member at least ½ inch wide will essentially guarantee that the two handles will approach one another in a predictable and consistent direction, such that the blade 22 will always match the gap 26 between the converging walls 16, 18. And by using a "springy" material for the connecting piece 58, the singe connecting piece can truly be said to provide the multiple functions of a hinge, a blade guide, and a handle-retraction (biasing) means. Looking at the same structure from a different perspective, it may be said that the biasing means 58 is adapted for continuously urging the handles 54, 56 away from each other so as to urge the blade 22 upwardly and away from the platform 14. The biasing means 58 may be said to have a relaxed or untensioned mode in which the handles 54, 56 are fully spread apart, e.g., about two inches; the movable blade 22 will be fully retracted at such a time. This full-open dimension is represented by the notation $D_r$ in FIG. 1.

The handles 54, 56 may be squeezed together to move the blade 22 between two major positions: one is a raised (or retracted) position and the other is a completely lowered position. When in its retracted position, the blade's cutting edge 28 is preferably about ¼ inch above the pill-supporting surface of the anvil-like platform 14; this dimension is represented by the notation $D_c$ in FIG. 1. This clearance is adequate for most of the pill-type medications (including aspirin, phenobarbital, ascriptin, mysoline, etc.) that are so frequently used in the medical field. Thus, with the blade 22 raised, a pill may be positioned immediately adjacent both walls 16, 18 and centered below the blade.

When the blade 22 is moved to its completely lowered position, any pill that is centered on top of the platform 14 will inherently be divided in half. The blade tip region 24 passes through the gap 26 until the cutting edge 28 almost contacts the pill-supporting surface of the platform 14. By use of the expression "almost contacts", it is intended to refer to enough separation to prevent the blade 22 from physically touching platform 14 (and thereby becoming dull as a result of repeatedly touching the platform surface), but not so much separation as to permit pill fragments from passing underneath the blade. In this way, the cutting edge 28 cooperates with the bottom edge 29 of separating member 30 (located behind the blade) to segregate the pill halves from each other. A separation distance of a couple of thousandths of an inch will be considered to meet the goal of having the blade cutting edge "almost contacting" the pill-supporting surface.

Figure 4:
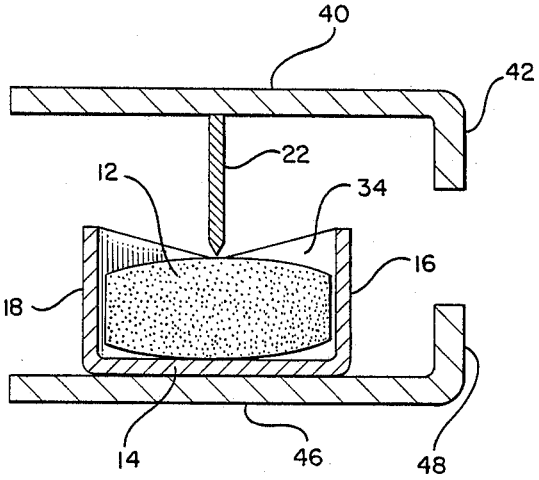
FIG. 4 is a cross-sectional view of the cutting blade and the pill, taken in the vertical plane indicated by the numerals 4—4 in FIG. 1 (with any structure not in the vertical plane being omitted for clarity), and showing the compartment-like structure in an open mode, with the blade in its retracted position above the pill.

The pill-dividing apparatus 10 includes a structural means for capturing that half of the pill (shown in FIG. 2) which is resting between the retaining wall 16 and blade surface 31—when the blade is in its completely lowered position. Having been once captured, this half of the pill will remain captured, i.e., it may be stored, as long as a squeezing force is maintained to keep the handles 54, 56 together. The storage structure precludes the captured portion from mixing with any portion of the pill lying on the other side of the blade 22 (and interiorly of retaining wall 18). Referring still to FIG. 3 and additionally to FIGS. 4 and 5, the storage means includes a compartment-like structure 34 which is opened when the blade 22 is in its retracted position and which is closed when the blade is in its completely lowered position. The blade 22 and the separating member 30 (to which the blade is mounted) are positioned in a tandem arrangement so as to form the left side of the compartment 34. The rest of the compartment periphery (as seen from the top of the compartment 34 that is shown in FIG. 2) is formed by the combination of end wall 32, side wall 36, and retaining wall 16; of course, all of these walls extend upwardly from the planar platform 14. The floor of compartment 34 is formed by the right side of platform 14, which is also referred to as side region 38. The compartment lid 45 is formed by a region of the handle 54 identified by a numeral 40. The region 40 has one edge bent downwardly so as to form a flange 42; this flange may be said to create the side of lid 45. The base region 46 (of handle 56) has an upwardly bent flange 48 which is configured to both locate and support the platform 14.

Figure 5:
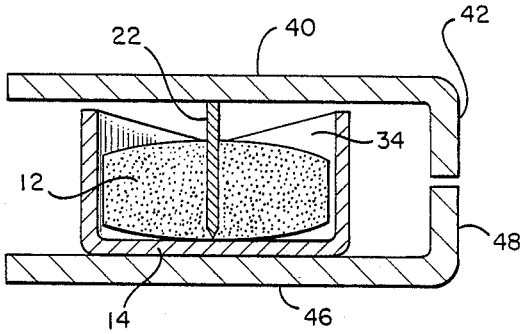
FIG. 5 is a cross-sectional view taken in the same plane as FIG. 4, but showing the pill after it has been divided by the blade (which is in its completely lowered position), and showing the compartment-like structure in a closed mode.

When the handles 54, 56 are gripped in a person's hand and squeezed together so as to move the blade 22 to its completely lowered position, downwardly directed flange 42 will be securely overlapped by the upwardly directed side wall 36, and blade 22 will come so close to the platform's pill-supporting surface (as seen in FIG. 5) as to effectively seal off the compartment 34. In this way, the apparatus 10 can be used to simultaneously capture one-half of a pill and leave the other half immediately accessible for use.

Affixed to the rearmost region 50 of the platform 14 is a chute-like or scoop-like structure 52 (as shown in FIGS. 1-3) which is adapted for easily dispensing the pill-half that is left outside the compartment 34. The chute-like structure 52 includes a tray 53 having two widely spaced guide walls 55, 57. The tray 53 extends outwardly from the side of the platform 14, and the end 51 of the tray is open. When the apparatus 10 is tilted sideways so as to orient the tray 53 downward, the "free" pill-half is readily dispensed through the discharge chute 52 into a person's hand, a glass, a storage bottle, etc.

Keeping the chute and compartment structures 52, 38 in mind, it will be appreciated that one-half of a divided pill may be easily dispensed through the chute, while the other half may be conveniently stored in the compartment—all without touching either half. This is because the discharge chute 52 is adapted to scoop up an undivided pill that is resting on a work surface. This design minimizes handling (i.e., grasping and touching) of whole pills or portions thereof so as to reduce the risk of dropping them on the floor and possibly contaminating them—in which case the medication (which may be very expensive) really ought to be thrown away. Also, in an environment where cleanliness is critical (such as in a hospital, emergency clinic, or the like), minimal handling of medication is preferred, especially if the user's hands are unclean or if the user could be infected with a contagious disease. If desired, the squeezed handles may be kept in their squeezed condition by wrapping a rubber band around the handles, with the result that any pill portion that is captured in the compartment 34 will remain captured until the rubber band is removed.

Figure 6:
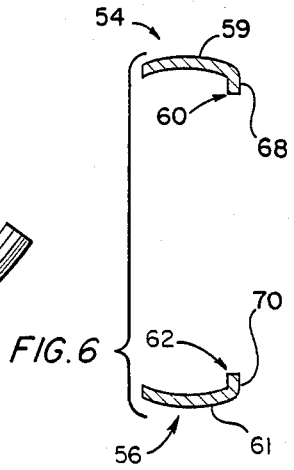
FIG. 6 is a cross-sectional view of the upper and lower handles in their fully retracted mode, taken in the vertical plane represented by the lines 6—6 in FIG. 1 (with any structure not in the vertical plane being omitted for clarity).

Referring once again to FIG. 1 and additionally to FIG. 6, each of the elongated handles 54, 56 preferably has a gently curved shape in both the lengthwise and widthwise directions, so as to foster comfort when the handles are held in the palm of a person's hand. As shown in FIG. 6, the handle edges 60, 62 are preferably bent so as to form flanges 68, 70 which are substantially perpendicular to the main handle portions 59, 61. By virtue of the substantially perpendicular bends, the handles 54, 56 are sufficiently rigid so as to resist twisting when they are squeezed together. Each of the handles 54, 56 preferably has a length of nearly $5\frac{1}{2}$ inches to provide adequate leverage so as to foster comfort and convenience when the apparatus 10 is used in cutting any number of pills. Keeping in mind the length and rounded-shape of the handles 54, 56, it will be appreciated that this construction makes it easier for persons with weakened hands, or those suffering from diseases such as arthritis, to grip and squeeze the handles 54, 56 in order to cut a pill into fractional dosages.

The apparatus 10 is compactly constructed and it is light-weight to foster easy handling; such an apparatus preferably occupies a space of about thirty cubic inches and weighs less than four ounces. The apparatus 10 is fairly thin, preferably having a width of only about $1\frac{1}{4}$ inches, and it may conveniently be stored in a bathroom medicine cabinet or carried in a hand bag or briefcase.

The chute 52, compartment walls 32, 36 and centering walls 16, 18 are preferably integrally formed with the platform 14 from one piece of metal, so as to reduce the machining and assembly steps that are required to manufacture the apparatus 10. The platform 14 is preferably welded to the handle base region 46; spot welding is mechanically acceptable, but silver soldering offers assurances that there will be no voids between any adjacent walls that might collect any particulate material, etc. Also, the L-shaped blade support 30 may be affixed to the handle end region 40 by a rivet 63, screw, etc.

In the preferred embodiment of the invention, the sharp blade 22 is detachably mounted to the blade support member 30 by a fastener 66 such as a small screw or the like. The support member 30 preferably has a threaded aperture which is sized and configured to receive a small screw 66. Obviously, the combination of the blade support member 30 and the mounting screw 66 function to serve as a means for detachably mounting the blade 22. When a fresh blade 22 is installed on the apparatus 10, the tip of the blade is inserted into a recess or cavity-like structure 64 which is sized and configured so as to envelop at least the major portion of the blade tip; this recess 64 is preferably formed by first cutting a slit and then structurally upsetting a portion of the end region 40 (of upper handle 54). The cavity-like structure 64 cooperates with screw 66 to hold the blade 22 in a substantially vertical mode, such that the cutting edge of the blade consistently passes through the gap 26 when the blade is lowered. The blade cutting edge 28 preferably has a length of about $\frac{3}{4}$ inch; this dimension is identified by the notation $L_b$ in FIG. 1. When the owner or primary user of the apparatus desires to change the blade 22, it may quickly and easily be replaced without the use of any tools other than an ordinary screwdriver; one readily available blade which may be used as a replacement may be found in many art supply stores under the brand name of "X-ACTO."

One major feature of the invention is that is it simply constructed using only a few pieces of material: one piece of metal is used for the two handles 54, 56 as well as the biasing means 58; another piece of metal is bent to form the platform 14, the compartment walls 32, 36, and the centering walls 16, 18; a third piece of metal serves as the structural support 30 for the blade; and only two fasteners are used, one each for attaching the member 30 and blade 22 to their respective structures. Thus, the apparatus 10 may be assembled using only five parts . . . plus the blade. Considering the small number of parts and the modest work required to prepare them, the apparatus 10 can be readily assembled and manufactured in large quantities at a low unit cost. Of course, molded plastic parts might be substituted for certain of the metal parts, if plastic should for some reason seem desirable.

In use, the pill dividing apparatus 10 may be readily operated with either a person's right or left hand. The handles 54, 56 are gripped in such a way that the region of a person's palm near the base of the thumb contacts the outer gripping surface 59 of upper handle 54, while the fingers of the hand curl around and contact the outer gripping surface 61 of lower handle 56. A pill is placed on the tray 53, either directly or through a scooping action with the wrist, and the front of the apparatus 10 (near the connecting means 58) is tipped slightly downward and to the right to cause the pill to slide inward to what has been described as the platform's pill-supporting surface. For increased confidence, the apparatus 10 may be gently shaken from side-to-side to confirm that the pill is centered between the converging walls 16, 18. Another advantage of the apparatus 10 will become apparent at this time, when the user recognizes that he has the opportunity to visually examine the exact placement of the pill within the centering means 16, 18—before the blade 22 is lowered. In other words, confirmation of correct centering may be accomplished before the pill is fractured; this is significant because a user does not have to break a pill and then compare the pieces to see if he has succeeded in realizing a 50/50 split. To divide a pill with this invention, the elongated handles 54, 56 are squeezed together until the movable blade 22 contacts the pill and begins to cut through its upper surface; the very sharp cutting edge will soon penetrate enough of the pill's surface to stabilize the pill and prevent it from sliding backward (away from walls 16, 18). Continued pressure on the handles will cause the blade 22 to either fracture the pill—if it is brittle—or cut through it, until the blade reaches its completely lowered position, at which time one half of the pill will be "free" and the other half will be captured. With one half of the pill securely captured in the compartment 34, the other "free" half may be discharged by tilting the chute 52 downwardly until the "free" half slides down the chute and into a person's hand, a spoon, a storage container, etc. If a person desires to release the captured half of the pill, gripping pressure on the handles 54, 56 is simply released, so that the blade 22 will return to its original, retracted position. The once-captured half of the pill may then be dispensed.

While only certain preferred embodiments of the invention are disclosed herein, it should be apparent to those skilled in the art that modifications can be made without departing from the spirit of the invention. For example, the handles could be made longer so as to provide even better leverage for persons with severely weakened hands. Also, an enlarged platform and a longer blade could be used for cutting large diameter pills which may be used by veterinarians or others in the medical field. Thus, any structure shown herein is intended to be exemplary and is not meant to be limiting, except as described in the claims appended hereto.

What is claimed is:

1. An apparatus for dividing a pill into two halves, with one half being immediately accessible and the second half being captured so that it may be held for later use, if desired, comprising:

(a) a platform adapted to support a pill in a generally horizontal mode;

(b) centering means for positioning a pill on top of the platform in such a way that the pill is bisected by a cleavage plane, regardless of the size of the pill;

(c) a movable blade mounted for moving in the cleavage plane such that any pill that is centered on top of the platform can be divided in half;

(d) means for capturing half of the pill adjacent the movable blade so as to preclude the captured portion of the pill from mixing with any portion of the remainder of the pill, and for holding the captured portion of the pill until such time as the movable blade is retracted; dispensing means including an opening which communicates with said platform top for dispensing the uncaptured remainder of the pill prior to retracting the movable blade; and (e) mechanical means for causing the movable blade to be moved at will to a pill-fracturing position and for retracting said movable blade at a desired time.

2. An apparatus for dividing a pill into two halves, with one half being immediately accessible and the second half being captured so that it may be held for later use, if desired, comprising:

(a) a platform adapted to support a pill in a generally horizontal mode;

(b) centering means for positioning a pill on top of the platform in such a way that the pill is bisected by a cleavage plane, regardless of the size of the pill;

(c) a movable blade mounted for moving in the cleavage plane such that any pill that is centered on top of the platform can be divided in half;

(d) means for capturing half of the pill adjacent the movable blade so as to preclude the captured portion of the pill from mixing with any portion of the remainder of the pill, and for holding the captured portion of the pill until such time as the movable blade is retracted;

(e) mechanical means for causing the movable blade to be moved at will to a pill-fracturing position and for retracting said movable blade at a desired time; and (f) a chute-like structure affixed to one side of the platform, said one side being away from said capturing means, and the chute-like structure being configured for scooping up a pill that is going to be divided, and there being an unobstructed path between the chute-like structure and the region where a pill is positioned in order to be divided, whereby the handling of a whole pill may be minimized.

3. The apparatus as claimed in claim 2 wherein the chute-like structure is more narrow than the platform upon which a pill is handled during a pill-splitting operation, whereby the chute-like structure is operable as a funnel to receive pill particles from a relatively wide region and dispense those particles through a relatively narrow outlet.

4. The apparatus as claimed in claim 1 and further including a cavity-like structure for enveloping the tip of said movable blade, and said cavity-like structure being formed from a portion of the mechanical means, whereby a digit of a person's hand is precluded from easily contacting said blade tip.

5. The apparatus as claimed in claim 1 wherein said centering means includes two converging walls affixed to the platform, with both walls being disposed to cooperate with each other so as to center a pill in such a way that the pill may be evenly divided by said movable blade.

6. The apparatus as claimed in claim 5 wherein said platform has a pill-supporting surface lying in a plane which is generally perpendicular to the cleavage plane, and wherein the convergent ends of each of the two converging walls are separated by a vertically extending gap having a width which is just sufficient to receive the movable blade.

7. The apparatus as claimed in claim 1 and further including a blade support member which is affixed to said mechanical means, wherein said blade support member including means for detachably mounting said movable blade, whereby a given blade may be manually replaced at will with a new blade.

8. The apparatus as claimed in claim 7 wherein the blade support member and the blade are fastened together in tandem arrangement so as to form a portion of said capturing means, whereby the bottom edge of the support member and cutting edge of the blade cooperate to effectively seal off the capturing means when said blade is in a completely lowered position.

9. An apparatus for dividing a pill into two halves, with one half being immediately accessible and the second half being captured so that it may be held for later use, if desired, comprising:

(a) a platform adapted to support a pill in a generally horizontal mode;

(b) centering means for positioning a pill on top of the platform in such a way that the pill is bisected by a cleavage plane, regardless of the size of the pill;

(c) a movable blade mounted for moving in the cleavage plane such that any pill that is centered on top of the platform can be divided in half;

(d) means for capturing half of the pill adjacent the movable blade so as to preclude the captured portion of the pill from mixing with any portion of the remainder of the pill, and for holding the captured portion of the pill until such time as the movable blade is retracted;

(e) mechanical means for causing the movable blade to be moved at will to a pill-fracturing position and for retracting said movable blade at a desired time; wherein said mechanical means includes a pair of elongated handles, and further including a means for connecting said handles in such a way that the handles may be selectively moved with respect to each other.

10. The apparatus as claimed in claim 9 and further including a connecting means for biasing said handles apart after the handles are brought together, whereby the movable blade is continuously urged away from the platform.

11. The apparatus as claimed in claim 10 wherein said handles and the connecting means are formed from a single piece of material.

12. The apparatus as claimed in claim 11 wherein the material from which the handles and the connecting means are made is a strap of Type 302 full hard stainless steel about $\frac{3}{4}$ inch wide.

13. The apparatus as claimed in claim 12 wherein the thickness of the strap of stainless steel is about 0.050 inch.

14. The apparatus as claimed in claim 9 wherein at least one longitudinal edge of each of the handles is bent so as to form a flange which is substantially perpendicular to the main portion of an associated handle, whereby said flanges tend to reinforce the handles and help them resist twisting when they are squeezed together.

15. The apparatus as claimed in claim 9 wherein each of the handles is curved in both a longitudinal and transverse direction, and wherein each handle has a length of about 5 inches.

* * * * *

UNITED STATES PATENT AND TRADEMARK OFFICE

CERTIFICATE OF CORRECTION

PATENT NO. : 4,824,000

DATED : April 25, 1989

INVENTOR(S) : Genevieve S. Baxter

It is certified that error appears in the above-identified patent and that said Letters Patent is hereby corrected as shown below:

In the Assignee's address on page one, please delete "Dallas, Tex." and insert --Lake Dallas, Tex.--.

In column 5, line 53, please delete "singe" and insert --single--.

Signed and Sealed this

Seventeenth Day of October, 1989

*Attest:*

DONALD J. QUIGG

*Attesting Officer*

*Commissioner of Patents and Trademarks*